United States Patent [19]

Levers et al.

[11] 4,189,511

[45] Feb. 19, 1980

[54] FILTER

[75] Inventors: William E. Levers, Cumberland, Md.; Charles H. Keith, Charlotte, N.C.

[73] Assignee: Celanese Corporation, Charlotte, N.C.

[21] Appl. No.: 757,708

[22] Filed: Jan. 7, 1977

Related U.S. Application Data

[63] Continuation of Ser. No. 627,588, Oct. 31, 1975, abandoned.

[51] Int. Cl.[2] ..... B32B 3/30; B32B 23/10

[52] U.S. Cl. ..... 428/167; 93/1 C; 131/267; 428/171; 428/172; 428/286; 428/288; 428/290; 428/296

[58] Field of Search ..... 131/10.9, 267; 428/156, 428/171, 198, 475, 507-510, 481, 288, 284, 290, 369, 296, 286, 167, 172; 156/180; 93/1 C; 264/136, 137, 176 F; 427/244, 278; 55/524

[56] References Cited

U.S. PATENT DOCUMENTS

| | | | |
|---|---|---|---|
| 2,966,198 | 12/1960 | Wylde | 156/180 |
| 3,148,101 | 9/1964 | Allmas, Jr. et al. | 428/296 |
| 3,214,323 | 10/1965 | Russell et al. | 428/198 |
| 3,220,904 | 11/1965 | Torsy et al. | 156/167 |
| 3,282,771 | 11/1966 | Goodman et al. | 428/303 |
| 3,341,394 | 9/1967 | Kinney | 264/24 |
| 3,407,822 | 10/1968 | Touey et al. | 131/266 |
| 3,595,731 | 7/1971 | Davies et al. | 428/296 |

FOREIGN PATENT DOCUMENTS

| | | | |
|---|---|---|---|
| 1315409 | 2/1962 | France | 427/176 |
| 1014223 | 12/1965 | United Kingdom . | |

OTHER PUBLICATIONS

Roberts, A. G., Organic Coatings, Properties, Selection and Use, Building Science Series 7, pp. 38-41, Feb. 1968.

"TYVEK", Spunbonded Olefin, Bulletin S-10, Dec. 1973, Dupont Technical Information.

*Primary Examiner*—Stanley S. Silverman

*Attorney, Agent, or Firm*—Robert J. Blanke

[57] ABSTRACT

Improved tobacco smoke filters, particularly cigarette filters, are prepared from a web of synthetic polymeric fibers having applied to at least one surface thereof a film-forming derivative of cellulose. Continuous processes and apparatus for the production of the web and filter are also described.

3 Claims, 3 Drawing Figures

FILTER

This is a continuation, of application Ser. No. 627,588, filed Oct. 31, 1975 now abandoned.

BACKGROUND OF THE INVENTION

An acceptable tobacco smoke filter, particularly a cigarette filter, must exhibit a high degree of filtration of tobacco smoke particles, i.e., have high smoke removal efficiency, at an acceptable draw resistance, i.e., pressure drop. The filter must also be capable of economical continuous production. Furthermore, it must be of a firmness sufficient to avoid collapse during smoking and must not unduly distort the taste and odor of the tobacco smoke.

Many materials including cellulose fibers and a variety of synthetic fibers have been suggested for use in tobacco smoke filters. Of these materials, only continuous filament cellulose acetate tow, and to a lesser degree, paper, have met with any degree of commercial acceptance.

There is a continuing search for new tobacco smoke filters meeting the above criteria and having improved smoke removal efficiencies.

SUMMARY OF THE INVENTION

It is an object of the present invention to provide improved tobacco smoke filters exhibiting a high degree of smoke removal efficiency with acceptable taste, firmness, draw resistance and economics.

It is another object to provide improved intermediate products useful in the formation of filters having the above characteristics.

Other objects of the present invention reside in the provisions for apparatus and processes for manufacture of the aforesaid filters and intermediate products.

Still other objects, if not specifically set forth herein, will be obvious to the skilled artisan upon reading the detailed description of the invention with reference to the drawings.

DRAWINGS

DETAILED DESCRIPTION OF THE INVENTION

Figure 1:
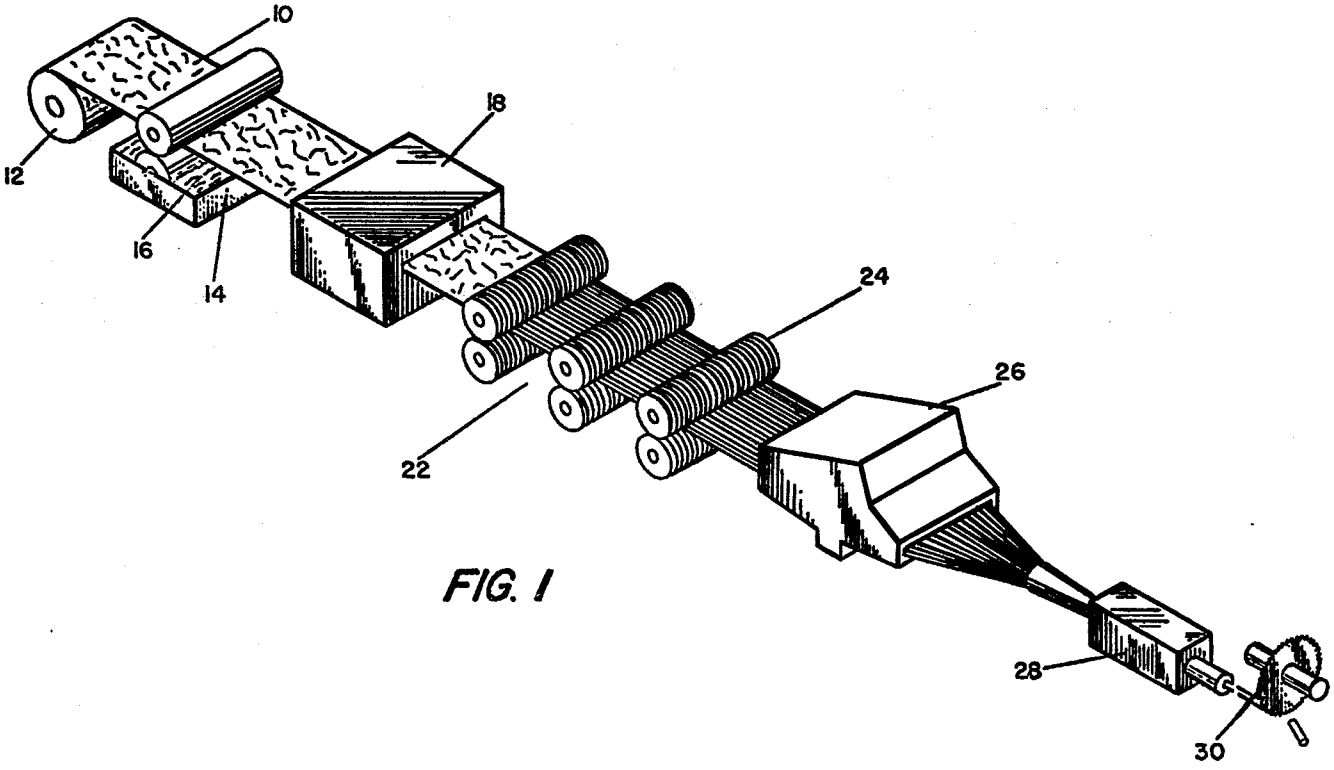
FIG. 1 is a perspective view of an apparatus suitable for the practice of the present invention.

Generally, the filters of the present invention are comprised of a condensed web of small diameter synthetic thermoplastic filaments, preferably of non-cellulosic composition, which are bound together by a film-forming derivative of cellulose.

Briefly, the intermediate products used in the preparation of the aforesaid filters are prepared by coating the fibers on at least one surface of a web of synthetic organic thermoplastic fibers and preferably substantially uniformly impregnating the web, with a solution or dope of a film-forming organic derivative of cellulose, removing solvent from the dope to at least partially produce a film, flexing the web to fracture or substantially destroy the film and produce a multiplicity of particles of the organic derivative of cellulose adhered to the fibers, applying a plasticizer to the web to render the particles tacky and condensing the web into filter form while the particles are in a tacky state.

Fibrous webs finding utility in the present invention may be prepared from a variety of synthetic, organic fibers including polyolefin, polyester, polyamide, and cellulosic fibers. The fibers in the web may be in the form of a tow of continuous filaments, a staple roving or randomly arranged as in a non-woven web.

Preferably, the web to be coated will have a total denier of from about 25,000 to about 120,000, and preferably from about 45,000 to about 65,000; a width of from about 2 to about 24 inches, and, for shipping purposes, preferably from 2 to about 8 inches; and a thickness from about 0.02 to about 0.25 inches.

The individual fibers comprising the web will ordinarily have a denier per filament of from about 0.01 to about 16 (equal to about 1–45 microns in diameter) with the lower denier per filament fibers, e.g., from about 0.01 to about 1.0 (equal to about 1–12 microns in diameter) being preferred.

If a tow of continuous filaments is employed, the tow will ordinarily have a total denier of from about 45,000 to 120,000 and be comprised of crimped continuous filaments having up to about 40, and preferably from about 5 to about 15 crimps per inch and a dpf of from about 0.5 to about 16. Such tows may be conveniently prepared, for example, from cellulose acetate or polyolefin filaments.

The preferred fibrous web for use in the present invention is a spray spun web having a surface area of from about 0.1 to about 2.0 $M^2/gm$, and preferably from about 0.4 to about 1.5 $M^2/gm$, composed of continuous filaments of a non-cellulosic polymer, preferably a polyolefin such as polypropylene or polyethylene. Such webs are produced by directing a molten stream of a fiber-forming thermoplastic polymer against a moving surface. Webs so produced are comprised of one or more randomly disposed continuous filaments fuse bonded at the fiber intersects as a result of the filaments, or separate portions of the same filament, coming into contact while the polymer is still in a molten state. More specifically, as a molten filament is projected against a surface, it tends to lay down onto the surface in a random pattern with successive portions of the filaments tending to loop about and lay down over preceding portions. As a result, a randomly arranged stereo reticulate mass of filamentary material is obtained. Ideally, the filaments are composed of a polyolefin having an intrinsic viscosity of from about 0.4 to about 1.25, and preferably from about 0.6 to about 0.75.

The dope applied to the web is comprised of a solution of a film-forming organic derivative of cellulose in a suitable solvent. Particularly desirable film-forming materials are the cellulose esters and cellulose ethers, including, but not limited to, cellulose acetate, cellulose propionate, cellulose acetate butyrate, cellulose acetate propionate, ethyl cellulose, methyl cellulose, sodium carboxymethyl cellulose, carboxymethyl hydroxyethyl cellulose, and mixtures thereof. Cellulose acetate, because of its cost and previous commercial acceptance is particularly suitable.

The solvent employed in the preparation of the dope is not critical and will vary somewhat depending on the film-forming compound employed. Organic solvents such as acetone, methyl ethyl ketone, or methylene chloride, normally liquid organic ethers and esters are ordinarily suitable. Water may also be used as a solvent with cellulose derivatives such as sodium carboxymethyl cellulose and cellulose acetates of certain acetyl values and molecular weights.

Ordinarily the dope will contain from about 3 to about 30 percent and preferably from about 6 to about 10 percent of the film-forming derivative based on the total amount of dope. Percentages outside the broader range may be used but difficulties in application or solvent removal may occur.

In the preferred embodiment of the invention, web 10 is withdrawn from a supply source 12, illustrated in the drawing as a roll although other sources such as a bale may be used, and directed to dope applicator 14 where dope 16 is applied to at least one surface of the web.

In the drawing, dope applicator 14 is shown as a transfer roll device. It is to be understood, however, that other types of applicators may be employed. For example, the cellulose acetate dope can also be readily applied with wick applicators, spray devices, and the like.

After web 10 is coated on at least one surface with dope 16, and preferably substantially, uniformly impregnated, it is passed to a dryer 18 where the solvent is removed and the web is dried. Ordinarily, dryer 18 will be comprised of a suitably heated chamber with a vacuum source which directs evaporated solvent to a recovery system, not shown. The structure of the particular device is not critical, however, so long as the web is substantially freed of solvent.

After solvent removal, treated web 10 may be taken up on a suitable collection means 20, which may be a roll or bale, for subsequent processing or shipment, or the web may be directly processed into tobacco smoke filter rods.

The intermediate product or treated web 10, will be comprised of from about 10 to about 40 and preferably from about 20 to about 30 percent of the film-forming cellulosic derivative, the derivative forming a film-like coating around and between at least a portion of the fibers. During collection for storage, the dried film may become somewhat fractured and discontinuous. This fracturing is not detrimental to the properties of the web, however, for reasons which will become apparent.

In the preparation of filter rods, the web is directed from collector 20, or drier 18, to flexing device 22 which further fractures or partially destroys the continuous structure of the film and increases the flexibility of the web, and a multiplicity of particles of the cellulosic derivative adhered to the fibers.

As earlier noted, the intermediate product of the present invention is desirably from about 2 to about 8 inches in width to facilitate packaging and shipping. If webs of this width are employed,, it is desirable at this stage to transversely stretch the web to a width of from 8 to 24 inches, in order to obtain the optimum filtration properties upon condensation of the web into a tobacco smoke filter. While this transverse stretching or opening can also occur after plasticizing of the web, prior stretching is preferred in order to obtain optimum plasticizer distribution.

Flexing device 22 as illustrated in the drawing is comprised of a plurality of roll pairs at least one roll of each pair being circumferentially grooved. A flexing device of this type is particularly suitable in the present invention in that it causes both flexing and stretching of the web to the desired width. This particular device does not constitute part of the present invention except as being illustrative of the fact that flexing and transverse stretching of the web can occur simultaneously.

Significant improvements in filtration properties are observed if, after flexing and optional transverse stretching, web 10 is passed through the nip of a pair of patterning rolls 24. In the drawing, patterning rolls 24 form part of flexing device 22. It is to be understood, however, that in the general aspects of the invention, patterning rolls 24 may be a device separate from flexing device 22.

Essentially, patterning rolls 24, at least one roll of the roll pair having a patterned surface, are adapted to afford a plurality of permanently depressed areas in the substrate. Said rolls 24 are positioned substantially transverse to the tow path and are arranged with parallel axes. Ordinarily, one roll of the pair will be adjacent the upper surface of the tow path, while the second roll will be mounted opposite said roll and below the tow path. However, the web may also follow a vertical path with a patterned roll mounted of either side of such path. The rolls 24 may be mounted yieldably in contact or slightly separated. The rolls should be of a proximity, however, sufficient to cause at least some permanent depression of the tow as its passes therebetween. Preferably, the separation of the rolls is from 0 to about 0.02 inches, and even more desirably from 0 to about 0.01 inches. The separation, of course, will depend upon a thickness of the tow as determined by the total denier and width thereof. Webs processed through rolls of the above separation will have an overall thickness of from about 0.1 to about 2.5 mm.

Figure 2:
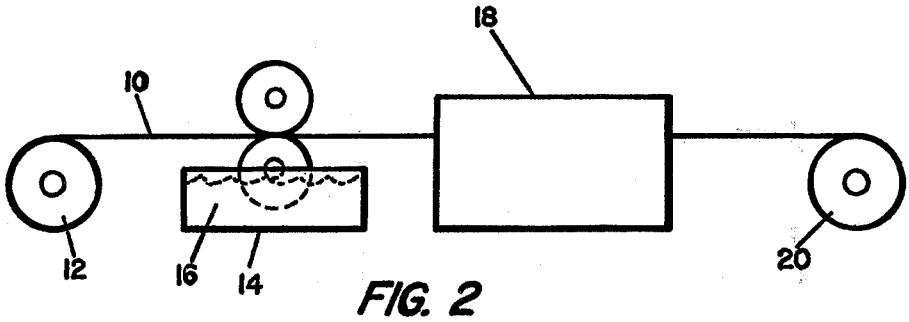
FIG. 2 is a side view of an apparatus suitable for use in forming the intermediate product.
Figure 3:
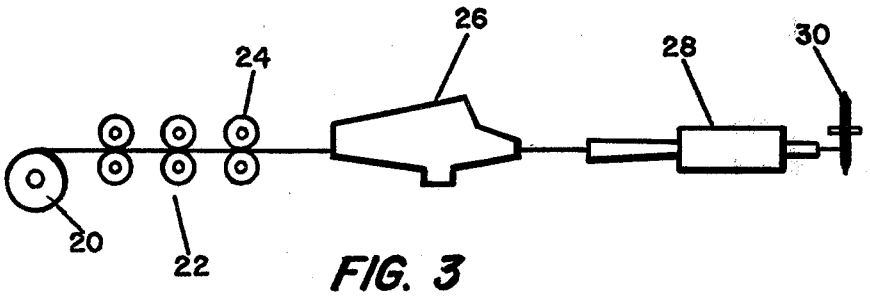
FIG. 3 is a side view of an apparatus suitable for use in forming tobacco smoke filters from the intermediate product.

In order to obtain the advantages of the present invention, a variety of patterns may be imparted to the surface of the web material. Such patterns may comprise continuous depressed areas and/or continuous lands. For example, a waffle or quilted surface as illustrated in FIG. 2 may be imparted to the surface of the web. In this pattern, either the continuous or discontinuous area may be compressed. The waffle or quilted pattern may also be oriented so that the edges of the pattern are at an angle to the longitudinal axis of the web, in effect imparting a diamond-shaped pattern as shown in FIG. 3 to the surface of the web. Generally, it has been found that the preferred patterns of the present invention from the standpoint of the greatest relative reduction in pressure drop comprise grooves defining a path substantially parallel to the longitudinal axis of the web. These longitudinal grooves preferably form a straight line along the web, i.e., accordian pleats; sinusoidal or zigzag grooves are also possible, however.

Desirably, the preferred rolls employed in the present invention are circumferentially or helically grooved, and will have from about 5 to about 80 and preferably from about 20 to about 45 grooves per inch. The lands of the rolls will ordinarily be of about 0.03 to about 0.005 inch and more preferably from about 0.015 to about 0.008 inch in width. The grooves will ordinarily be about 0.035 to about 0.005 and preferably from about 0.002 to about 0.001 inch in depth. The lands of a given roll will ordinarily, but not necessarily, be of uniform width. In fact, lands which progressively decrease in width outwardly from the center of the patterned area may aid in the construction of a more uniform filter. Similarly, the depths of the grooves may be of differential dimensions across the web.

Rod firmness can be improved by using rectangular or substantially rectangular grooves, since such grooves tend to yield a material which, upon gathering into rod form, has self-supporting, triangular-shaped, difficulty compressible channels. The term substantially rectangular grooves is intended to define a groove wherein the angle from the vertical of the wall is from 0° to 45° and preferably from 0° to 30°. It is, of course, within the scope of the present invention to use other grooved shapes, e.g., semi-circular, trapezoidal, or triangular grooves.

In some instances, the use of heated patterned rolls has been found to be of value in obtaining improved corrugation. When used, the heated rolls will generally have a temperature of from about 25° to 225° C. and preferably from about 110° to about 160° C.

Preferably, patterning rolls 24 are at least 2 inches in diameter, and more preferably, from about 4 to about 8 inches in diameter. The width of the patterned portion of the rolls will, of course, be determined, to some extent, by the width of the web being structured. Generally, a total patterning width of from about 8 to about 16 inches is sufficient for most operations.

After flexing and optional transverse stretching and/or patterning, web 10 is directed to plasticizer applicator 26 where a plasticizer, i.e., a solvation agent, is applied to the web cause the cellulosic particles to become tacky. In the drawing, plasticizer applicator 26 is a cylindrical plasticizer applicator of the type described in U.S. Pat. No. 3,387,992, issued June 11, 1968. Essentially applicator 26, is comprised of a housing, a rotatable disc located within the housing below the path of the web and substantially transverse thereto, means for conveying a plasticizer to the rotatable disc and means for recycling unused plasticizer. Other applicators which are adapted to apply plasticizer to a continuous fibrous web may also be used for this purpose.

For example, applicators utilizing wicks or spray nozzles are also usuable.

Ordinarily, from about 3 to about 25 percent plasticizer based on the amount of cellulosic derivative will be applied, with about 6 to about 15 percent being preferable. Triacetin will normally be employed after plasticizing, particularly when the cellulosic derivative is cellulose acetate. However, other organic solvents such as triethyl citrate, dimethyl ethyl phthalate, or the dimethyl ethers of triethylene or tetraethylene glycol may also be used. Water will also find utility as a plasticizer with certain of the hereinbefore described cellulosic derivatives.

The web, after being treated with a plasticizer, is directed into filter rod maker 28 where the web is condensed into tobacco smoke filter rods which will ordinarily be of about 8 mm in diameter and severed to 60 to 180 mm in length. Filter rods of this length are desirable in that they are readily severable into 6 filters of 10 to 30 mm in length for attachment to tobacco columns.

The following examples are presented for the purpose of illustration only and are not to be taken as in limitation of the present invention.

EXAMPLES 1-6

Spray spun webs of polypropylene fibers were substantially, uniformly impregnated with a dope of cellulose acetate polymer dissolved in acetone. The coated webs were then dried and flexed to destroy the film-like properties of the cellulose acetate film produced. A triacetin plasticizer was applied to the webs which were then patterned with 20 parallel, longitudinal, rectangular grooves per inch. The web was then condensed into cigarette filters of 20 mm in length and 24.8 mm in circumference. The composition, based on total weight of product, and surface area of the webs were as follows:

TABLE I

| | FILTER TIP PROPERTIES | | | |
|---|---|---|---|---|
| Intermediate Product | % Polypropylene | % CA | % Triacetin | Specific Surface Area $M^2/gm$ |
| 1 | 70.8 | 25.8 | 3.4 | 0.50 |
| 2 | 67.9 | 28.4 | 3.7 | 0.53 |
| 3 | 70.6 | 26.5 | 2.9 | 0.40 |
| 4 | 67.1 | 29.2 | 3.7 | 0.54 |
| 5 | 68.8 | 27.7 | 3.5 | 0.41 |
| 6 | 70.8 | 25.8 | 3.4 | 0.50 |

The pressure drops of filaments prepared from the above intermediate product was determined. The filaments were then attached to 65 mm tobacco columns and smoke nicotine and "tar" (total particulate matter, less nicotine and water) removal efficiencies were determined. The following results were obtained.

TABLE II

| | SMOKING PERFORMANCE | | | | |
|---|---|---|---|---|---|
| Intermediate Product | ΔP mm,$H_2O$ | & SRE | & NRE | & TRE | & Compressibility |
| 1 | 64 | 66.5 | 61.0 | 62.1 | 31.6 |
| 2 | 62 | 59.3 | 53.2 | 53.7 | NOT TESTED |
| 3 | 65 | 53.7 | 48.6 | 48.0 | NOT TESTED |
| 4 | 60 | 59.6 | 55.6 | 54.4 | 38.2 |
| 5 | 55 | 56.3 | 50.6 | 48.3 | 43.8 |
| 6 | 70 | 67.3 | 64.0 | 62.4 | 31.6 |

For purposes of comparison, conventional cellulose acetate filters having a pressure drop of from 55 to 70 mm water have a smoke removal efficiency of about 42 to about 52 percent, a nicotine removal efficiency of about 32 to about 42%, and a tar removal efficiency from about 35 to about 45%.

EXAMPLE 7

A band of crimped, continuous polypropylene filaments having approximately 20 crimps per inch, a denier per filament of 0.9 and a total denier of 50,500 was substantially uniformly impregnated with a dope of 6 percent, based on the weight of dope, of cellulose acetate polymer dissolved in acetone, and dried to produce an intermediate product comprised of approximately 60% polypropylene fiber and 40% cellulose acetate. This material was flexed and patterned with 20 rectangular, longitudinal, parallel grooves per inch. Ten percent triacetin based on the cellulose acetate was applied thereto. The plasticized material was then formed into cigarette filters exhibiting desirable smoke removal efficiencies, pressure drop, and firmness.

While the foregoing description has dealt only with the preparation of a filter from an impregnated web of a fibrous material, it is also possible to prepare satisfactory and often improved filters by incorporation of one or more other filtration materials into the web material prior to corrugation. Such materials include carbon, silica gel or other high surface area absorbents, granular polyurethanes, cellulose acetate flake, wood pulp, flock, liquid additives and other gas adsorbents or selective absorbents. Generally, up to about 20% of these materials based on the weight of the filter may be employed, with from about 5% to about 10% being preferably utilized. Obviously, a multiplicity of, and tows comprising the same of different filamentary materials could be combined to form suitable filter structures as described herein.

Filters prepared by the above method may be used as the sole filtration means on a cigarette. It is, of course, possible to use filters prepared by the present invention as part of a dual or segmented filter. In this context, the present filters are particularly suitable in combination with paper filters and conventional cellulose acetate filters.

It is to be understood that the foregoing detailed description is given merely by way of illustration and that many variations may be made therein without departing from the spirit and scope of the invention.

What is claimed is:

1. An intermediate product adapted for use in the manufacture of improved cigarette filters comprising a web of polyolefin filaments and a dried flexing fracturable film of cellulose acetate, said film coating one surface of said web; said web being comprised of a random stereo reticulated array of filaments produced by causing successive portions of the filaments of said web to be looped about and laid down over preceding filament portions, substantially all of said web having a total denier of about 25,000 to about 120,000 and a surface area of from about 0.1 to about 2.0 square meters per gram, said intermediate product having a pattern configuration impressed into at least one surface thereof.

2. The intermediate product of claim 1 wherein said cellulose acetate is present in an amount of about 10 to 40 percent, based on the weight of the intermediate product.

3. The intermediate product of claim 1 wherein said pattern configuration comprises grooves defining a path substantially parallel to the longitudinal axis of said web.

* * * * *